US006634407B1

(12) United States Patent
Strohmeyer

(10) Patent No.: US 6,634,407 B1
(45) Date of Patent: Oct. 21, 2003

(54) THROUGH-SCREEN ACCESS ASSEMBLY FOR HOSES, POWER CORDS AND THE LIKE

(76) Inventor: Kyle J. Strohmeyer, 4207 Ohio Ave., Tampa, FL (US) 33616

( * ) Notice: Subject to any disclaimer, the term of this patent is extended or adjusted under 35 U.S.C. 154(b) by 0 days.

(21) Appl. No.: 10/119,348

(22) Filed: Apr. 10, 2002

(51) Int. Cl.[7] ..... E06B 7/28
(52) U.S. Cl. ..... 160/180; 160/116; 160/117
(58) Field of Search ..... 160/116, 117, 160/90, 180, 181, 354, 368.1; 49/67, 168, 169

(56) References Cited

U.S. PATENT DOCUMENTS 1,535,045 A * 4/1925 Scheidecker ..... 160/180
2,708,927 A * 5/1955 Dixon et al. ..... 160/180
4,840,217 A * 6/1989 Evans, III ..... 160/368.1
4,856,575 A * 8/1989 Wells ..... 160/353
5,117,890 A * 6/1992 Taylor et al. ..... 160/180
5,301,737 A * 4/1994 Martin ..... 160/380
5,343,889 A * 9/1994 Jaw ..... 137/232
5,351,718 A * 10/1994 Barton ..... 138/92
6,385,909 B1 * 5/2002 Marsh et al. ..... 49/169

* cited by examiner

*Primary Examiner*—Bruce A. Lev

(57) ABSTRACT

A through-screen access assembly for hose, power cords and the like for allowing a user to pass power cords, hoses or the like through a screen. The through-screen access assembly for hose, power cords and the like includes a first through-screen access member being adapted to securely and removably mount upon an inner side of a screen; and also includes a second through-screen access assembly including a second through-screen access member being adapted to securely and removably mount upon an outer side of the screen; and further includes a closure member for removably closing access through the first and second through-screen access members.

6 Claims, 2 Drawing Sheets

THROUGH-SCREEN ACCESS ASSEMBLY FOR HOSES, POWER CORDS AND THE LIKE

BACKGROUND OF THE INVENTION

1. Field of the Invention

The present invention relates to through-screen accesses and more particularly pertains to a new through-screen access assembly for hose, power cords and the like for allowing a user to pass power cords, hoses or the like through a screen.

2. Description of the Prior Art

The use of through-screen accesses is known in the prior art. More specifically, through-screen accesses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 328,064; 2,854,072; 2,832,406; 4,350,198; 4,334,573; and Pat. No. Des. 326,914.

While these devices fulfill their respective, particular objectives and requirements, the aforementioned patents do not disclose a new through-screen access assembly for hose, power cords and the like. The prior art describes inventions having access through doors to allow pets to go in and out of the building structure.

SUMMARY OF THE INVENTION

The general purpose of the present invention, which will be described subsequently in greater detail, is to provide a new through-screen access assembly for hose, power cords and the like which has many of the advantages of the through-screen accesses mentioned heretofore and many novel features that result in a new through-screen access assembly for hose, power cords and the like which is not anticipated, rendered obvious, suggested, or even implied by any of the prior art through-screen accesses, either alone or in any combination thereof. The inventive device includes a first through-screen access member being adapted to securely and removably mount upon an inner side of a screen; and also includes a second through-screen access assembly including a second through-screen access member being adapted to securely and removably mount upon an outer side of the screen; and further includes a closure member for removably closing access through the first and second through-screen access members. None of the prior art describes using plate members being attached to a screen with openings through the plate members to allow power cords and hoses to be extended therethrough.

There has thus been outlined, rather broadly, the more important features of the through-screen access assembly for hose, power cords and the like in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new through-screen access assembly for hose, power cords and the like which has many of the advantages of the through-screen accesses mentioned heretofore and many novel features that result in a new through-screen access assembly for hose, power cords and the like which is not anticipated, rendered obvious, suggested, or even implied by any of the prior art through-screen accesses, either alone or in any combination thereof.

Still another object of the present invention is to provide a new through-screen access assembly for hose, power cords and the like for allowing a user to pass power cords, hoses or the like through a screen.

Still yet another object of the present invention is to provide a new through-screen access assembly for hose, power cords and the like that can be easily and conveniently mounted to any screen.

Even still another object of the present invention is to provide a new through-screen access assembly for hose, power cords and the like that saves the screen from being damaged while allowing access through the screen These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
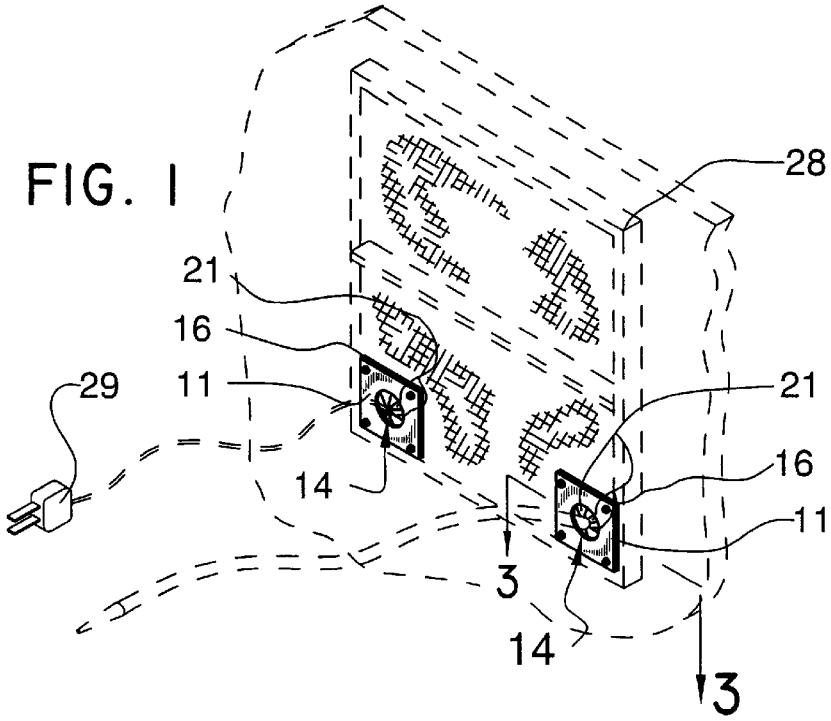
FIG. 1 is a perspective view of a new through-screen access assembly for hose, power cords and the like according to the present invention and shown in use.
Figure 2:
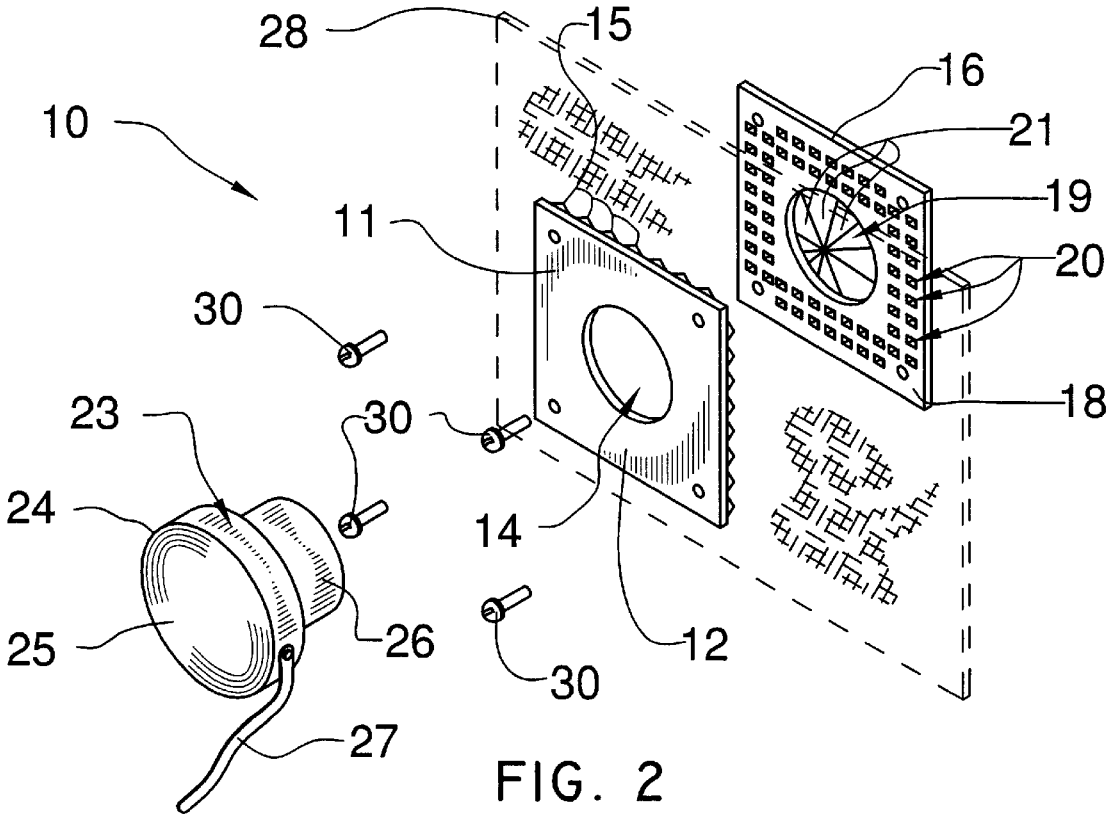
FIG. 2 is an exploded perspective view of the present invention.
Figure 3:
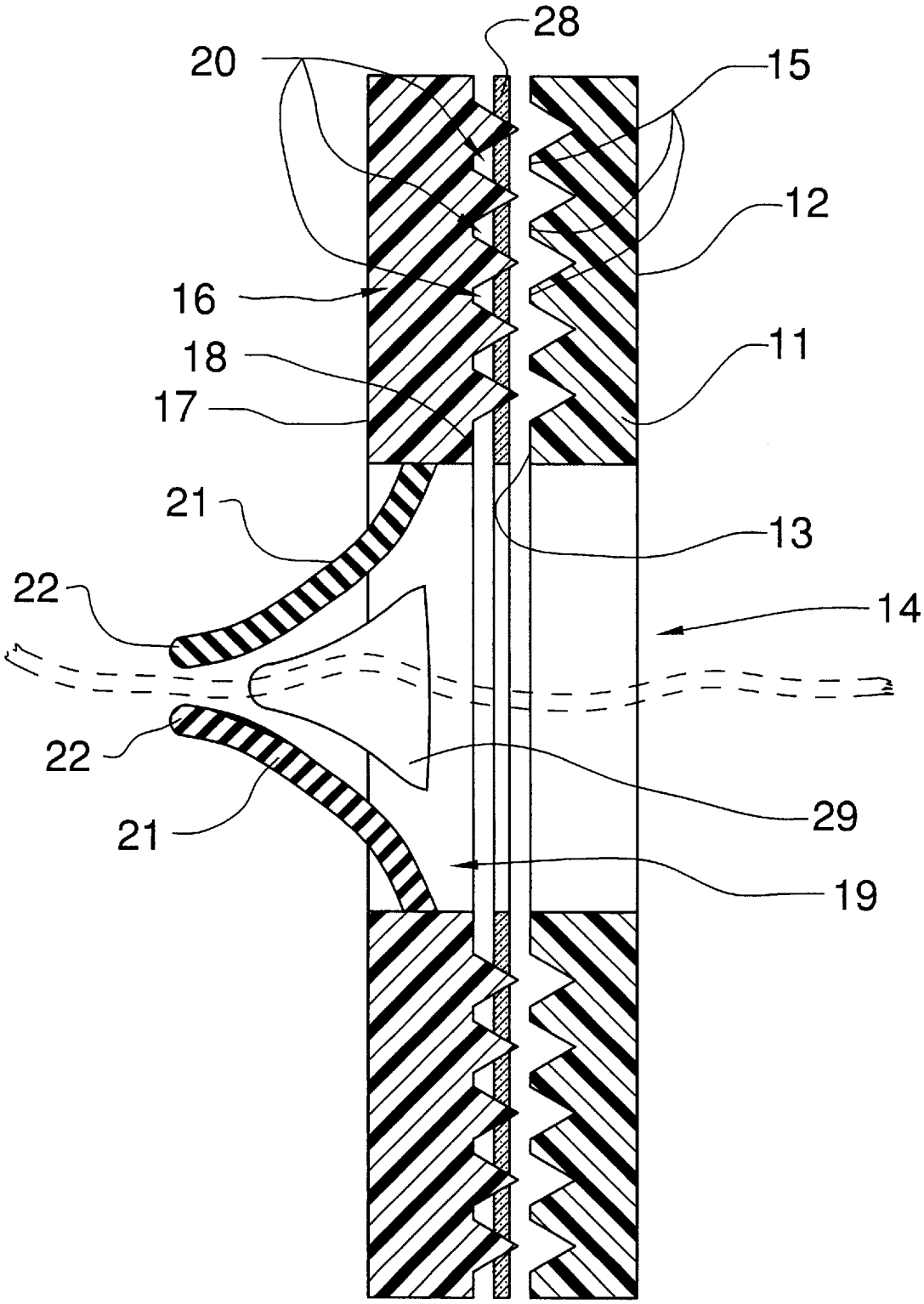
FIG. 3 is a cross-sectional view of the present invention.

With reference now to the drawings, and in particular to FIGS. 1 through 3 thereof, a new through-screen access assembly for hose, power cords and the like embodying the principles and concepts of the present invention and generally designated by the reference numeral 10 will be described.

As best illustrated in FIGS. 1 through 3, the through-screen access assembly for hose, power cords and the like 10 generally comprises a first through-screen access member 11 being adapted to securely and removably mount upon an inner side of a screen 28. The first through-screen access member 11 is a first plate member having a front side 12 and a back side 13 and further having an opening 14 being disposed therethrough. The first plate member 11 also has a plurality of teeth members 15 being conventionally and integrally disposed upon and extending outwardly from the back side 13 thereof. A second through-screen access member 16 is adapted to securely and removably mount upon an outer side of the screen 28. The second through-screen access member 16 is a second plate member 16 having a front side 17 and a back side 18 and further having an opening 19 being disposed therethrough. The first and second plate members 11,16 are fastenable together with fasteners 30. The second plate member 16 also includes a plurality of slots 20 being arrangedly disposed in the back side 18 thereof and being adapted to removably receive the teeth members 15 of the first plate member 11. A plurality of resilient flap members 21 is securely and conventionally attached to an edge forming the opening 19 of the second plate member 16 and is movably disposed in the opening 19 of the second plate member 16. The resilient flap members 21 are triangular-shaped and have vertexes 22 which generally removably meet along an axis of the opening 19 of the second plate member 16 to close the opening 19 therethrough.

A closure member 23 for removably closing access through the first and second through-screen access members 11,16 is removably disposed in the openings 14,19 of the first and second plate members 11,16 and includes a plug 24 and a tab member 27 being conventionally connected to the plug 24 for removing the plug 24 from the openings 14,19. The plug 24 has a cap portion 25 and a boss portion 26 extending outwardly from the cap portion 25 and being adapted to fit snugly in the openings 14,19. The tab member 27 is securely and conventionally attached to the cap portion 25 of the plug 24.

In use, the user fastens the first and second plate members 11,16 on opposite sides of the screen 28 and makes an opening through the screen 28. The user then inserts hoses or power cords 29 through the openings 14,19 in the first and second plate members 11,16 for whatever use the user intends to use the hoses or power cords 29. Once finished, the user can close the openings 14,19 with the plug 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the through-screen access assembly for hose, power cords and the like. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A through-screen access assembly for hoses, power cords comprising:

a first through-screen access member being securely and removably mounted upon an inner side of a screen, said first through-screen access member being a first plate member having a front side and a back side and further having an opening being disposed therethrough, said first plate member also having a plurality of teeth members being disposed upon and extending outwardly from said back side thereof;

a second through-screen access member being securely and removably mounted upon an outer side of the screen, said second through-screen access member is a second plate member having a front side and a back side and further having an opening being disposed therethrough, said first and second plate members being fastenable together with fasteners, said second plate member also including a plurality of slots being arrangedly disposed in said back side thereof and being adapted to removably receive said teeth members of said first plate member; and a closure member for removably closing access through said first and second through-screen access members.

2. The through-screen access assembly for hoses, power cords as described in claim 1, further comprises a plurality of resilient flap members being movably disposed in said opening of said second plate member.

3. The through-screen access assembly for hoses, power cords as described in claim 2, wherein said resilient flap members are triangular-shaped and have vertexes which generally removably meet along an axis of said opening of said second plate member to close said opening therethrough.

4. A through-screen access assembly for hoses, power cords comprising:

a first through-screen access member being securely and removably mounted upon an inner side of a screen, said first through-screen access member being a first plate member having a front side and a back side and further having an opening being disposed therethrough, said first plate member also having a plurality of teeth members being disposed upon and extending outwardly from said back side thereof;

a second through-screen access assembly including a second through-screen access member being securely and removably mounted upon an outer side of the screen, said second through-screen access member is a second plate member having a front side and a back side and further having an opening being disposed therethrough, said first and second plate members being fastenable together with fasteners; and a closure member for removably closing access through said first and second through-screen access members, said closure member being removably disposed in said openings of said first and second plate members and including a plug and a tab member connected to said plug for removing said plug from said openings.

5. The through-screen access assembly for hoses, power cords as described in claim 4, wherein said plug has a cap portion and a boss portion extending outwardly from said cap portion and being adapted to fit snugly in said openings.

6. The through-screen access assembly for hoses, power cords as described in claim 5, wherein said tab member is securely attached to said cap portion of said plug.

* * * * *